US007621625B2

(12) United States Patent
Graveson et al.

(10) Patent No.: US 7,621,625 B2
(45) Date of Patent: Nov. 24, 2009

(54) INK JET DEVICE WITH INDIVIDUAL SHUT-OFF

(75) Inventors: Sandra J. Graveson, Enfield, NH (US); Alan Menard, Ashford, CT (US)

(73) Assignees: Heidelberger Druckmaschinen AG, Heidelberg (DE); FUJIFILM Dimatix, Inc., Lebanon, NH (US)

( * ) Notice: Subject to any disclaimer, the term of this patent is extended or adjusted under 35 U.S.C. 154(b) by 321 days.

(21) Appl. No.: 11/095,387

(22) Filed: Mar. 31, 2005

(65) Prior Publication Data

US 2006/0232644 A1 Oct. 19, 2006

(51) Int. Cl.
*B41J 2/175* (2006.01)

(52) U.S. Cl. ..... 347/85

(58) Field of Classification Search ..... 347/49, 347/84, 85, 87; 118/300, 117, 118
See application file for complete search history.

(56) References Cited

U.S. PATENT DOCUMENTS 4,038,667 A * 7/1977 Hou et al. ..... 347/35
5,177,500 A * 1/1993 Ng ..... 347/245
5,701,148 A 12/1997 Moynihan et al. ..... 347/92
5,719,605 A * 2/1998 Anderson et al. ..... 347/59
5,856,839 A * 1/1999 Aukstikalnis et al. ..... 347/86
5,933,172 A * 8/1999 Park et al. ..... 347/85
6,012,806 A * 1/2000 de Olazabal ..... 347/85
6,033,061 A * 3/2000 Niedermeyer et al. ..... 347/86
6,116,719 A * 9/2000 Maza ..... 347/22
6,281,916 B1 * 8/2001 VanSteenkiste ..... 347/85
6,357,867 B1 * 3/2002 Hine ..... 347/89
6,540,340 B2 * 4/2003 Thorpe et al. ..... 347/85
6,705,712 B2 * 3/2004 Usui et al. ..... 347/86
2002/0047882 A1 * 4/2002 Karlinski et al. ..... 347/85
2003/0007040 A1 * 1/2003 Love et al. ..... 347/85
2005/0034658 A1 2/2005 Palifka et al. ..... 118/313

* cited by examiner

*Primary Examiner*—Anh T. N. Vo
(74) *Attorney, Agent, or Firm*—Davidson, Davidson & Kappel, LLC

(57) ABSTRACT

An ink jet print head includes an ink delivery system and a plurality of ink jet modules connected to the ink delivery system, the plurality of ink jet modules including a first ink jet module and a second ink jet module. The ink delivery system includes a first cut-off device selectively blocking ink flow to the first ink jet module and a second cut-off device of the ink delivery system selectively blocking ink flow to the second ink jet module.

13 Claims, 9 Drawing Sheets

INK JET DEVICE WITH INDIVIDUAL SHUT-OFF

BACKGROUND OF THE INVENTION

The present invention relates generally to ink jet devices.

U.S. Pat. No. 6,357,867 discloses an ink jet print head with a plurality of ink jet modules mounted on a manifold sandwich including an orifice plate. Ink received through an inlet opening in a frame passes through openings in a filter layer and is distributed to ink inlet openings in the ink jet modules. U.S. Pat. No. 6,357,867 is hereby incorporated by reference herein, as is U.S. Pat. No. 5,701,148 and U.S. Patent Application Publication No. US 2005/0034658.

SUMMARY OF THE INVENTION

An object of the present invention is provide for individual ink shut-off to each module in an ink jet print head containing a plurality of ink jet module.

The present invention provides an ink jet print head having an ink delivery system and a plurality of ink jet modules connected to the ink delivery system, the plurality of ink jet modules including a first ink jet module and a second ink jet module, the ink delivery system including a first cut-off device selectively permitting or blocking ink flow to the first ink jet module. A second cut-off device of the ink delivery system selectively permits or blocks ink flow to the second ink jet module.

By having a cut-off device in the ink delivery system for individual ink jet modules, individual ink jet modules advantageously can be serviced without having to drain the entire ink jet print head. Such entire draining can waste ink, cause excessive downtime, and create the potential for spillage.

Preferably, the ink delivery system includes a common ink inlet for the first and second ink jet modules. The ink delivery system may have a first ink outlet and a second ink outlet for the first and second ink jet modules, respectively. The first cut-off device may be located between the common ink inlet and the first ink outlet and the second cut-off device between the common ink inlet and the second ink outlet.

The cut-off devices may be screw shut-off valves, for example.

The cut-off devices may pinch flexible tubing in the ink delivery system.

The present invention also provides an ink jet print head having an ink delivery system and a plurality of ink jet modules connected to the ink delivery system, the plurality of ink jet modules including a first ink jet module and a second ink jet module, the ink delivery system including a first ink passage delivering ink to the first ink jet module, a second ink passage delivering ink to a second ink passage, a first ink disconnect valve connected to the first ink passage, a second ink disconnect valve connected to the second passage, and a removable module having a common ink inlet connected to a first outlet and a second outlet, the first outlet interacting with the first disconnect valve and the second outlet interacting with the second disconnect valve so that when the module is connected to the ink delivery system, the first and second disconnect valves are open, and then the module is removed the first and second disconnect valves are closed.

DETAILED DESCRIPTION OF THE PREFERRED EMBODIMENTS

Figure 1:
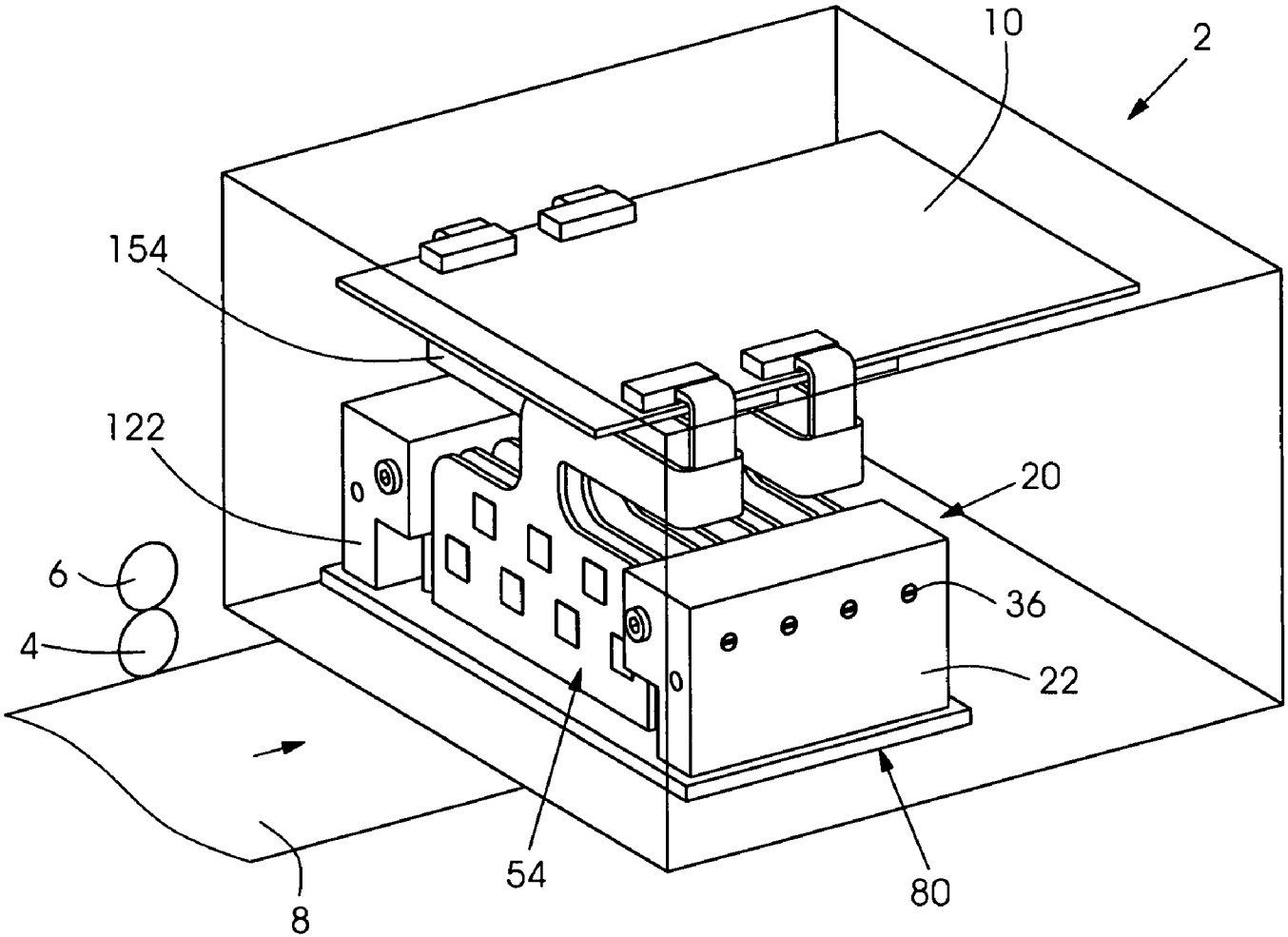
FIG. 1 shows a first embodiment of the present invention with individual cut-off valves.

FIG. 1 shows an ink jet print head 2 having plurality of ink jet modules 54, 154 which may be similar for example to ink jet modules described in incorporated-by-reference U.S. Pat. No. 6,357,867 and each of which may have an ink inlet at a bottom section thereof. The ink jet modules 54, 154 may be connected to a registration plate 80 having openings for the ink jet nozzles and connections for the ink jet modules 54, 154. The registration plate 80 also may have an ink passage for each ink module, each ink passage having an outlet connecting to a respective ink inlet of an ink jet module 54, 154. An electronics board 10 may control delivery of ink through the nozzles of the ink jet modules 54, 154 so that ink is delivered through the nozzle to print a substrate.

The ink jet print head 2 can print for example a sheet of material 8, which has been printed earlier for example using offset lithographic printing units, shown schematically in FIG. 1 with a blanket cylinder 4 and plate cylinder 6. For example, four different color offset lithographic printing units may be provided.

Four or more ink jet modules 154 may be connected to the left edge of the electronics board 10 and be interleaved with four or more ink jet modules 54 connected to the right edge of electronic board 10. The individual ink inlets for modules 154 may be on the left in FIG. 1, and the individual ink inlets for the modules 54 on the right in FIG. 1

The registration plate 80 may also support an ink delivery system 20, here ink manifold modules 22, 122.

Figure 2:
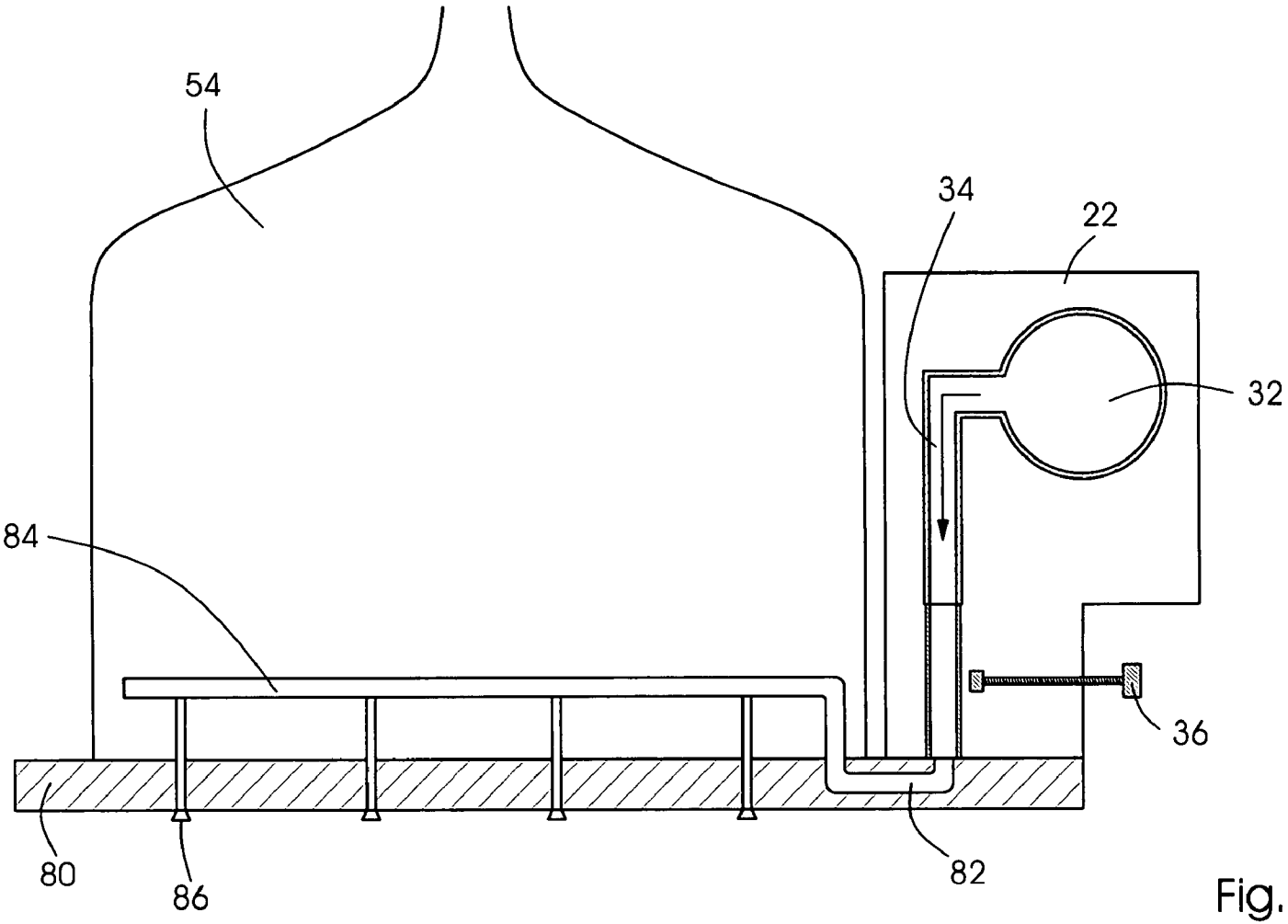
FIG. 2 shows a schematic side view of the ink flow.

As shown schematically in FIG. 2, ink for the ink jet print head flows into the manifold 22 through a common ink inlet 32, and then down an individual channel 34. Registration plate 80 has an ink passage 82 for each module and may pass the ink through a filter.

The ink then passes to an ink inlet 84 for the module 54, and may be subjected to a low pressure via membranes, for example as described in incorporated-by-reference U.S. Pat. No. 6,357,867, before passing to nozzles 86, of which there may be many more than as shown here schematically.

A cut-off device 36 can provide individual shut-off of the ink flow to the individual module 54, and thus can make repair easier. Other modules need not be drained, with the corresponding problems after draining of air and impurities in the ink being avoided for those modules.

Figure 3:
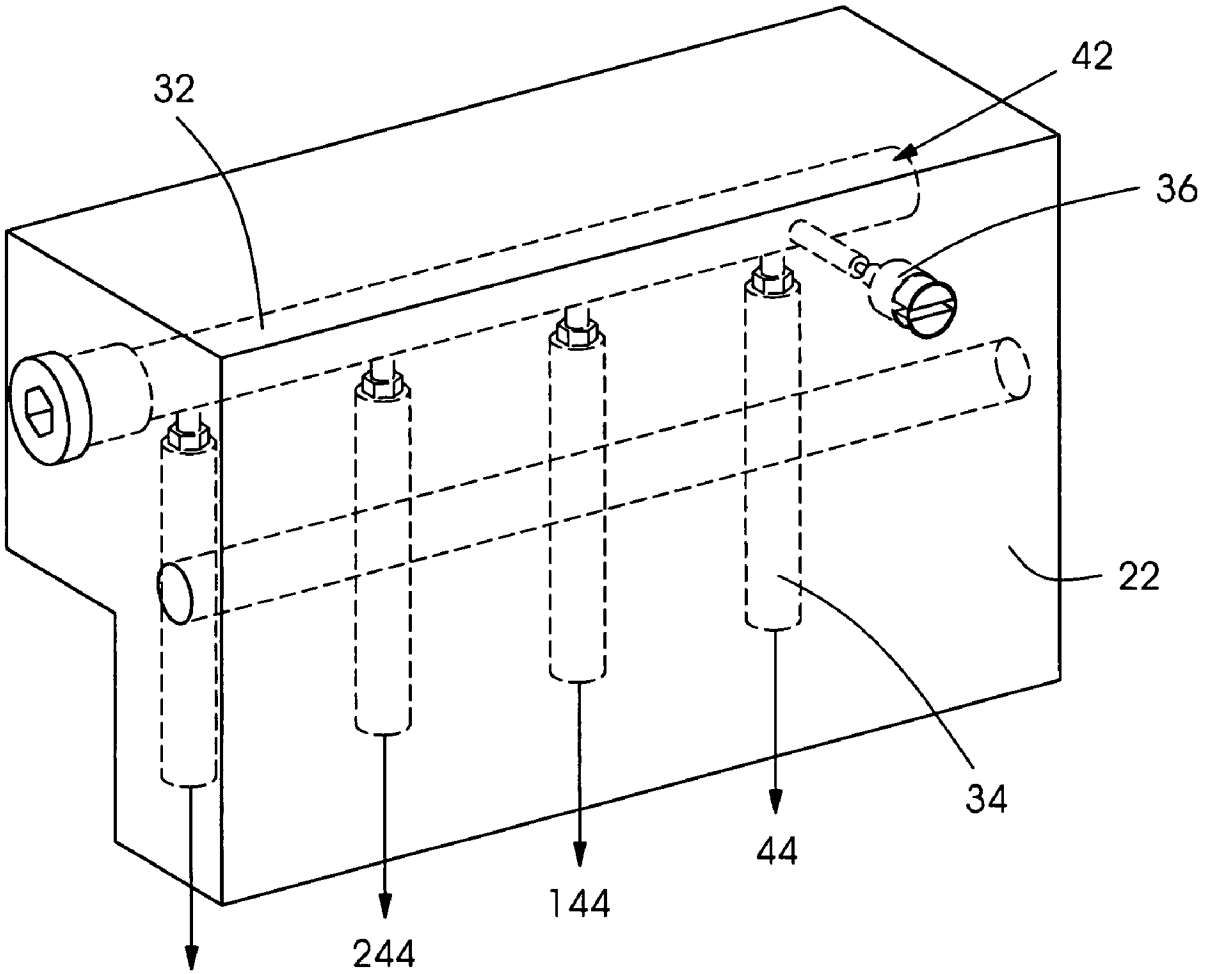
FIG. 3 shows the ink delivery system in more detail.

FIG. 3 shows an embodiment of ink manifold module 22. Ink enters via a supply 42 to common ink inlet 32, where it passes through one of four ink channels 34 to exit to the registration plate 80 at ink outlets 44, 144, 244, 344.

Figure 4A:
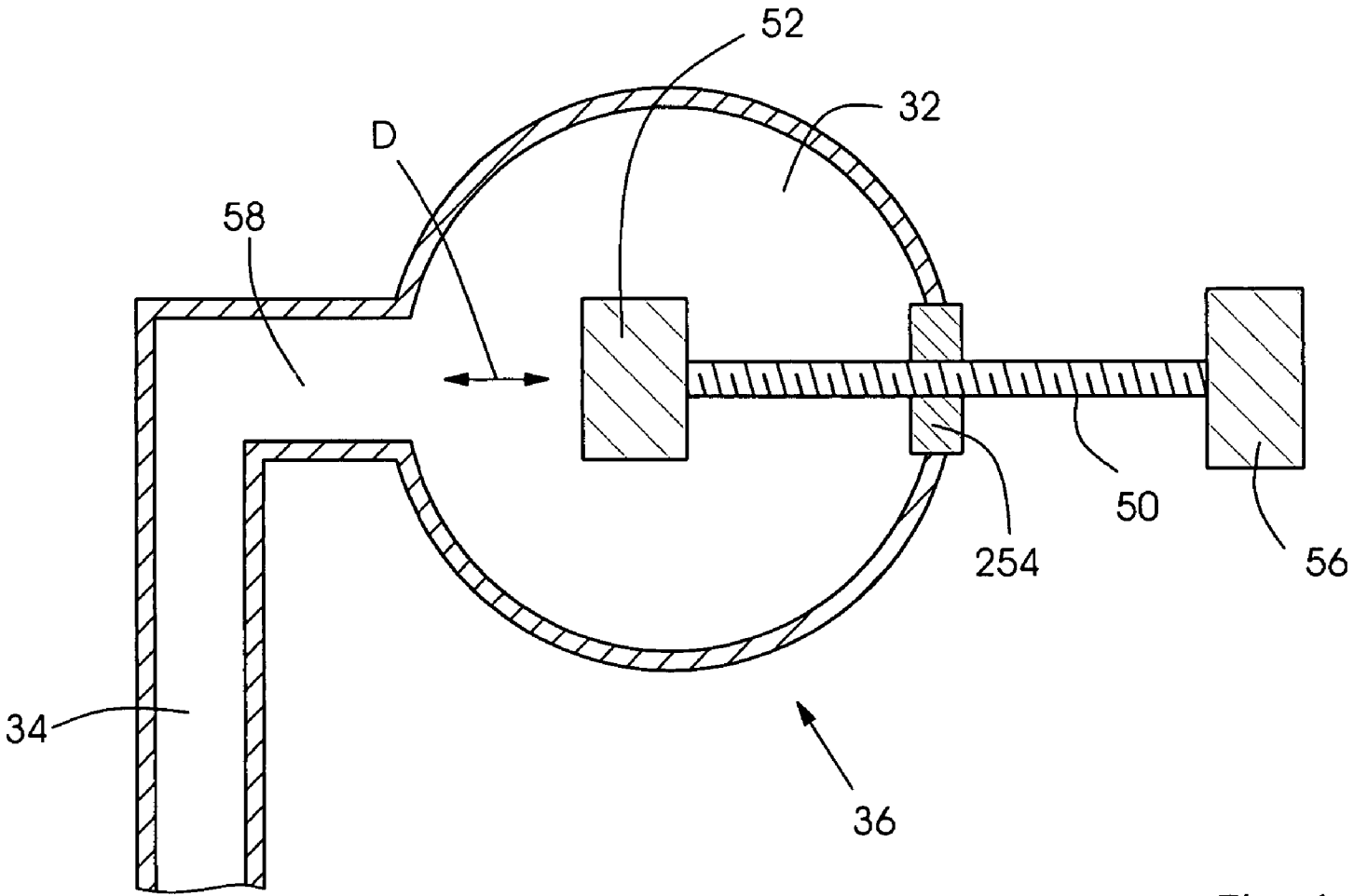
FIGS. 4*a* and 4*b* show one embodiment of the cut-off device in an open and shut position respectively.
Figure 4B:
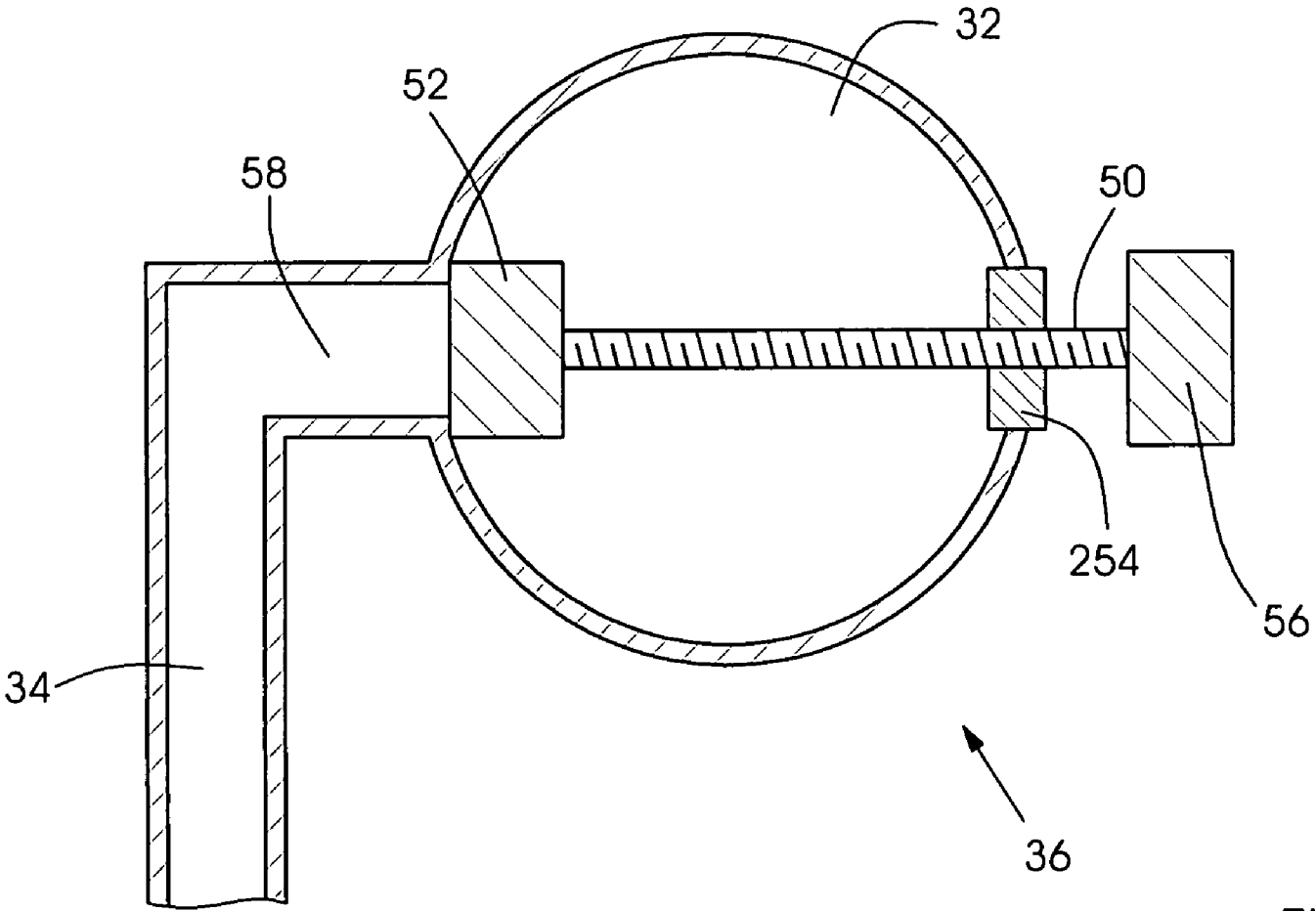

FIG. 4*a* shows one embodiment of the cut-off device 36, which may have for example a plunger 52 selectively blocking a hole between the common ink inlet 32 and ink channel 34. The plunger 52 may be at the end of a threaded member 50 which interacts with an interiorly-threaded nut 254 sealingly fixed to the wall of inlet 32. A knob or screw-head 56 may be used to turn the threaded member 50 to move the plunger back and forth in direction D. FIG. 4*b* shows the plunger 52 closing off hole 58 to block ink flow to one of the modules 54.

Figure 5:
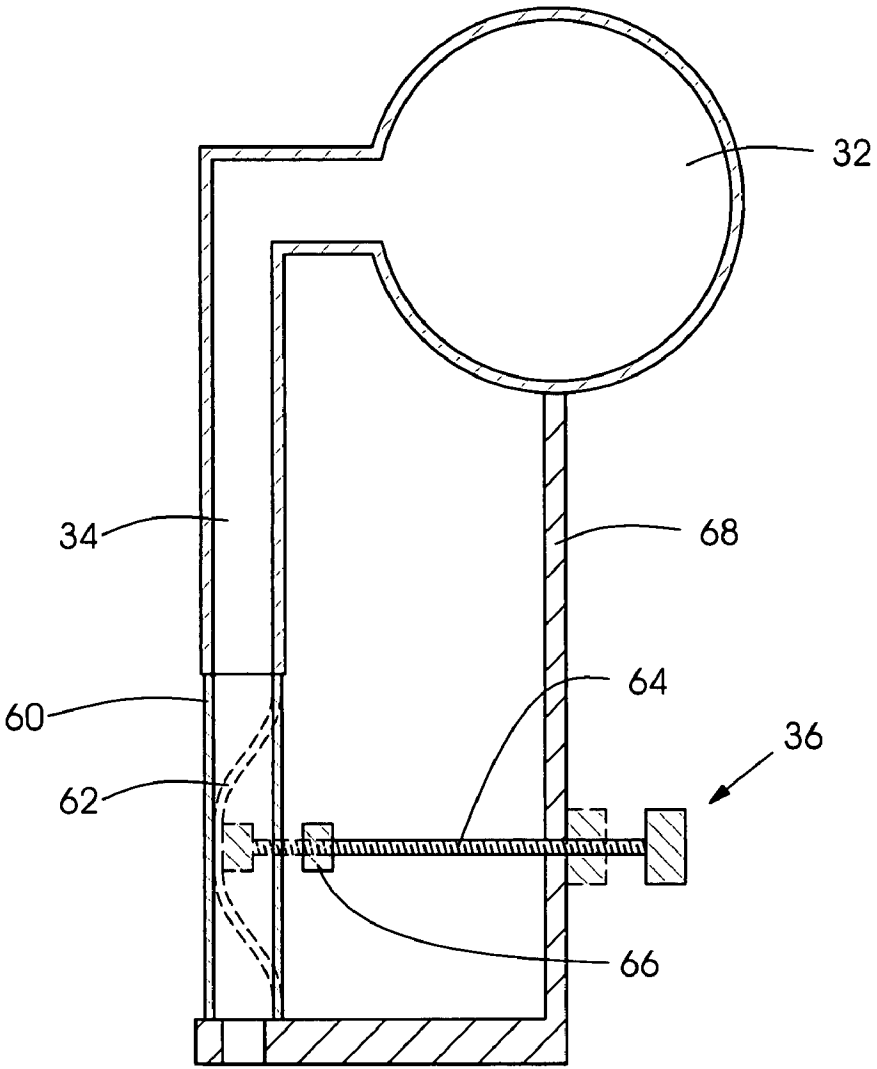
FIG. 5 shows another embodiment of the cut-off device.

FIG. 5 shows an alternate embodiment in which a cut-off device 36 with a threaded member 64 supports a pusher 66. Threaded member 64 may be supported in interior threads of a support 68, so that the pusher 66 can pinch a flexible tube 60 as shown by dashed lines 62. The ink flow in channel 34 thus may be shut-off without the risk of contaminants entering the ink.

Of course, other cut-off devices may be used, including electrically-controlled ones.

Figure 6:
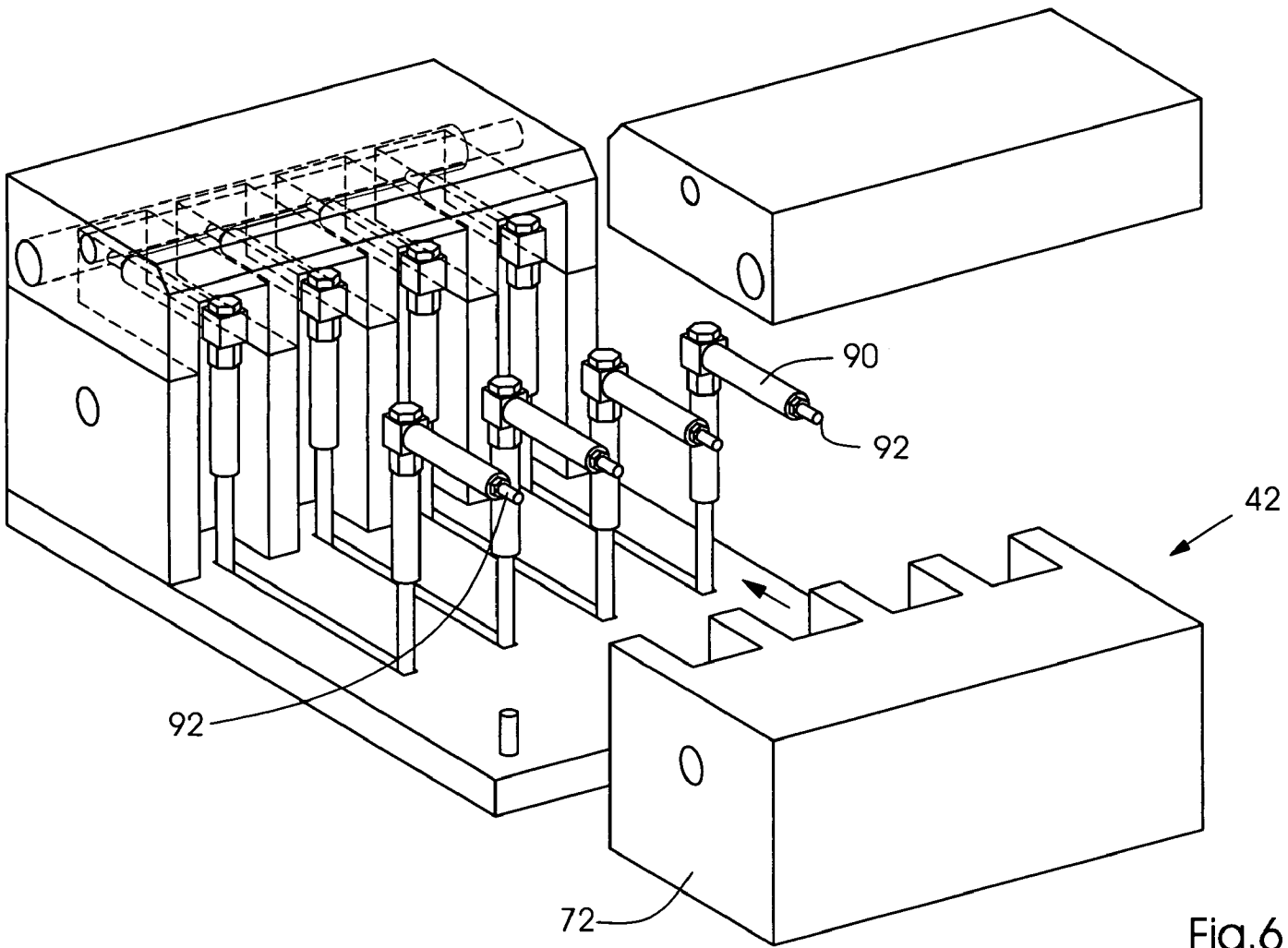
FIG. 6 shows another embodiment of the present invention.
Figure 7:
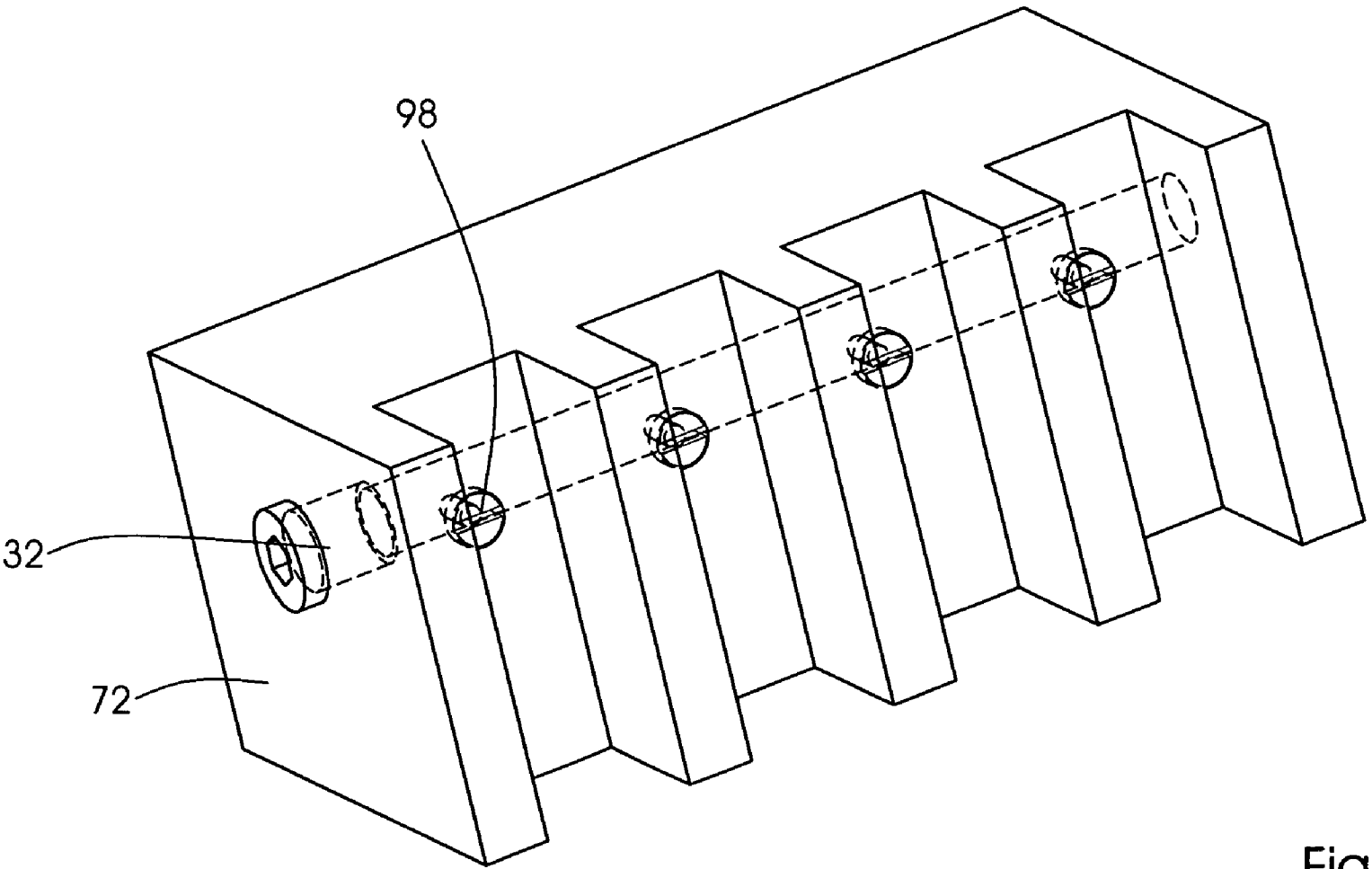
FIG. 7 shows a module for use with the FIG. 6 embodiment.
Figure 8:
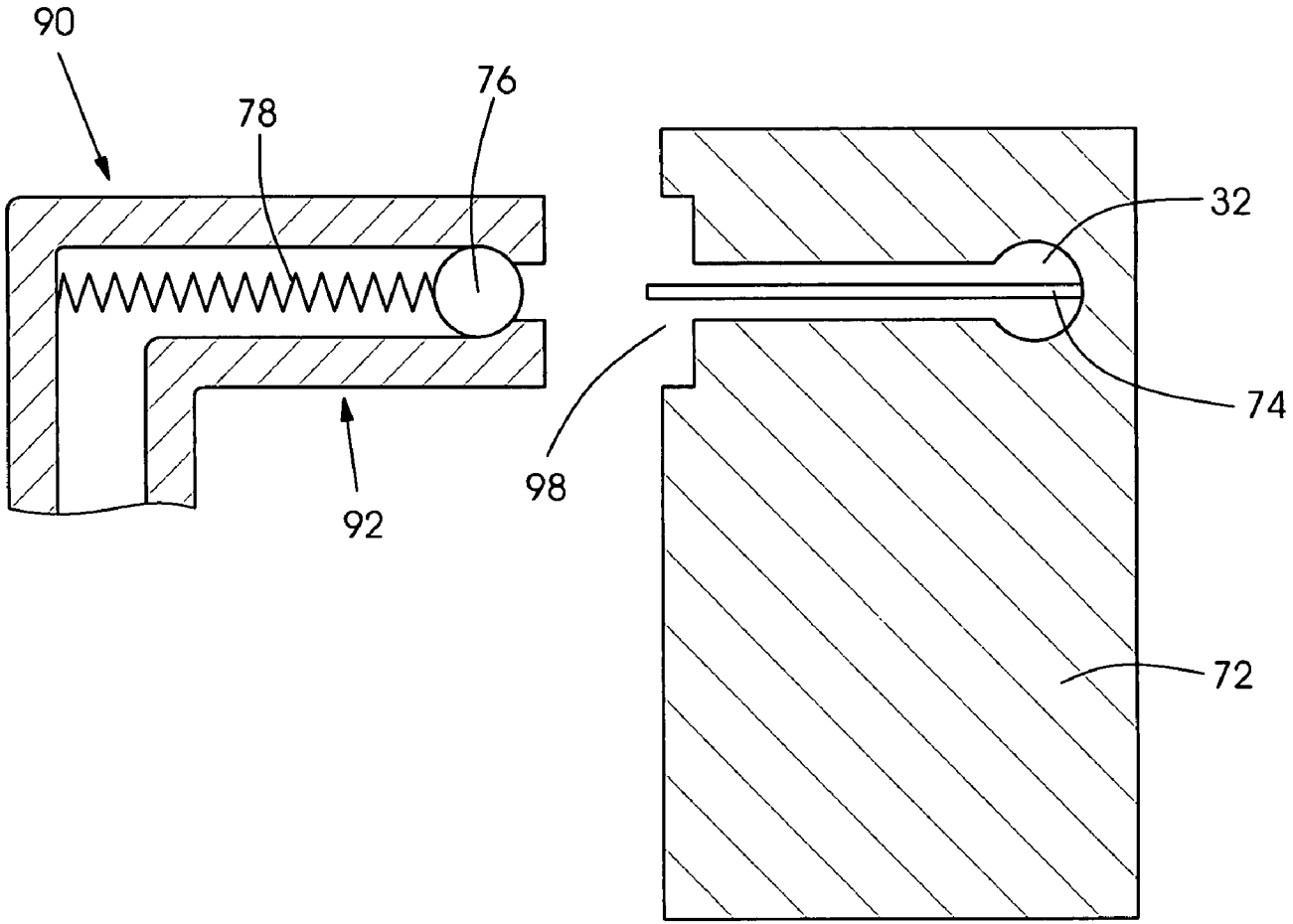
FIG. 8 shows a quick disconnect valve of the FIG. 6 embodiment.

FIG. 6 shows an alternate embodiment of the present invention in which all ink flow may be cut to four modules on one side by removing a quick-release ink manifold module 72. Four ink channels 90 may be fixed to the registration plate 80, via for example flexible tubing 92 to permit minor movement of the ink channels 90 to aid in minor variations between the ink channel 90 location and the ink manifold module 72 but to provide enough stiffness to permit the ink manifold module 72 to be connected. As shown in FIG. 7, the ink manifold module 72 includes a common ink inlet 32 and four exits 98 to connect to ink channels 90. As shown in FIG. 8, each ink channel 90 has a quick-release valve 92 so that when module 72 is removed, contamination of ink in channel 90 is avoided. Drainage of the ink jet modules 54 is not required as well. The quick release valve 92 may include a ball 76 attached to a spring 78. A needle 74 can push in the ball when the quick-release manifold module 72 is connected to permit ink flow into channel 90.

"Ink" as defined herein may be any liquid applied to a sheet material and capable of being exited using ink jet technology, and may include for example both pigmented liquids and colorless liquids such as varnishes, and ink as defined herein also may include biological or chemical fluids capable of being delivered as drops.

LIST OF REFERENCE NUMERALS

4 blanket cylinder
6 plate cylinder
8 sheet
10 electronics board
20 ink delivery system
22 ink manifold module
32 common ink inlet
34 channel
36 cut-off device
42 ink supply
44 ink outlet
50 threaded member
52 plunger
54 ink jet module
56 knob or screw-head
58 hole
60 tube
62 second tube position
64 threaded member
66 pusher
68 support
72 ink manifold module
74 needle
76 ball
78 spring
80 registration plate
82 ink passage
84 ink inlet
86 nozzles
90 ink channel
92 flexible tube
98 ink exit
122 ink manifold module
144 ink outlet
154 ink jet module
244 ink outlet
254 nut
344 ink outlet

What is claimed is:

1. An ink jet print head comprising:
an ink delivery system;
a registration plate; and
a plurality of ink jet modules connected to the ink delivery system and the registration plate, the plurality of ink jet modules including a first ink jet module and a second ink jet module, each of the plurality of ink jet modules including a plurality of nozzles;
the registration plate having a plurality of openings formed therein so that each of the plurality of the nozzles passes through a respective one of the plurality of openings;
the ink delivery system including a first cut-off device selectively blocking ink flow to the first ink jet module and a second cut-off device of the ink delivery system selectively blocking ink flow to the second ink jet module.

2. The ink jet print head as recited in claim 1 wherein the ink delivery system includes a common ink inlet for the first and second ink jet modules.

3. The ink jet print head as recited in claim 2 wherein the ink delivery system includes a first ink outlet and a second ink outlet for the first and second ink jet modules.

4. The ink jet print head as recited in claim 3 wherein the first cut-off device is located between the common ink inlet and the first ink outlet and the second cut-off device between the common ink inlet and the second ink outlet.

5. The ink jet print head as recited in claim 1 wherein the first and second cut-off devices rotate to selectively block flow.

6. The ink jet print head as recited in claim 1 wherein the ink delivery system include flexible tubing and the first cut-off device is capable of pinching the flexible tubing.

7. A printing machine comprising the ink jet print head as recited in claim 1.

8. The printing machine as recited in claim 7 further comprising an offset lithographic printing unit printing a same material substrate as the ink jet print head.

9. The ink jet print head as recited in claim 1 wherein the registration plate includes a plurality of ink passages, the plurality of ink passages including a first ink passage and a second ink passage, the first ink passage connecting the first ink jet module to the ink delivery system and the second ink passage connecting the second ink jet module to the ink delivery system.

10. An ink jet print head comprising:
an ink delivery system; and
a plurality of ink jet modules connected to the ink delivery system, the plurality of ink jet modules including a first ink jet module and a second ink jet module, the ink delivery system including a first ink passage delivering ink to the first ink jet module, a second ink passage delivering ink to the second ink jet module, a first ink disconnect valve connected to the first ink passage, a second ink disconnect valve connected to the second passage, and a removable quick-release module having a common ink inlet, a first outlet and a second outlet, the common ink inlet connected to the first outlet and the second outlet, the first outlet interacting with the first disconnect valve and the second outlet interacting with the second disconnect valve so that when the removable quick-release module is connected to the ink delivery system, the removable quick-release module causes the first and second disconnect valves to open so that the first outlet is in fluid connection with the first ink passage through the first disconnect valve and the second outlet is in fluid connection with the second ink passage through the second disconnect valve, and when the removable quick-release module is removed from the ink delivery system the first and second disconnect valves are closed;

wherein the first outlet contacts the first ink disconnect valve and the second outlet contacts the second ink disconnect valve when the removable quick-release module is connected to the ink delivery system and the first outlet does not contact the first ink disconnect valve and the second outlet does not contact the second ink disconnect valve when the removable quick-release module is not connected to the ink delivery system.

11. The ink jet print head as recited in claim 10 wherein the first and second ink disconnect valves are quick release valves, the first quick release valve being openable by contact with the first outlet and the second quick release being openable by contact with the second outlet.

12. The ink jet print head as recited in claim 11 wherein the first outlet includes a first device causing the first quick release valve to open and the second outlet includes a second device causing the second quick release valve to open when the removable quick-release module is connected to the ink delivery system.

13. The ink jet print head as recited in claim 12 wherein the first quick release valve includes a first ball attached to a first spring, the second quick release valve includes a second ball attached to a second spring, the first device causing the first ink disconnect valve to open by contacting the first ball and compressing the first spring when the removable quick-release module is connected to the ink delivery system and the second device causing the second ink disconnect valve to open by contacting the second ball and compressing the second spring when the removable quick-release module is connected to the ink delivery system.

* * * * *